United States Patent [19]

Ware et al.

[11] Patent Number: 4,865,130

[45] Date of Patent: Sep. 12, 1989

[54] HOT GAS GENERATOR WITH INTEGRAL RECOVERY TUBE

[75] Inventors: Charles H. Ware, Charleston, W. Va.; Robert M. Amundson, Roanoke, Va.

[73] Assignee: WorldEnergy Systems, Inc., Fort Worth, Tex.

[21] Appl. No.: 208,343

[22] Filed: Jun. 17, 1988

[51] Int. Cl.[4] ..... E21B 43/24; E21B 36/02

[52] U.S. Cl. ..... 166/303; 166/61; 166/62; 166/57; 166/261

[58] Field of Search ..... 166/261, 303, 61–63, 166/256, 257, 57–59

[56] References Cited

U.S. PATENT DOCUMENTS

| | | | |
|---|---|---|---|
| 3,018,827 | 1/1962 | Henderson et al. | 166/257 |
| 3,456,721 | 7/1969 | Smith | 166/59 |
| 3,982,591 | 9/1976 | Hamrick et al. | 166/302 |
| 4,452,309 | 6/1984 | Widmyer | 166/59 X |
| 4,463,803 | 8/1984 | Wyatt | 166/59 |
| 4,597,441 | 7/1986 | Ware et al. | 166/272 X |
| 4,609,041 | 9/1986 | Magda | 166/62 |

*Primary Examiner*—Bruce M. Kisliuk

*Attorney, Agent, or Firm*—Arthur F. Zobal

[57] ABSTRACT

A housing surrounds a portion of a tubular member forming a combustion chamber in the annulus between the housing and the tubular member. The housing has an upper end and a lower end with a port for the passage of hot gases. The tubular member has a port at a lower end portion. The tubular member and housing are located in a borehole and oxygen and hydrogen are injected into the chamber to form a combustible mixture which is ignited and burned to form combustion gases for flow through the port of the housing into the borehole. Steam is injected through the tubular member for cooling the housing and the combustion gases. After a period of time, the injection of the oxygen, hydrogen and steam is terminated and a pump is lowered into the tubular member for pumping fluids in the borehole upward through the tubular member to the surface. Instead of steam, an excess of hydrogen may be injected into the combustion chamber for cooling purposes.

26 Claims, 5 Drawing Sheets

HOT GAS GENERATOR WITH INTEGRAL RECOVERY TUBE

BACKGROUND OF THE INVENTION

1. Field of the Invention

The invention is directed to a system and process for recovering petroleum from underground reservoirs.

2. Description of the Prior Art

U.S. Pat. No. 3,982,591 discloses a gas generator to be located in a borehole for use for recovering hydrocarbons or other materials from underground formations. U.S. Pat. No. 4,597,441 discloses a process of using a gas generator of the type disclosed in U.S. Pat. No. 3,982,591 wherein the gas generator is located in a borehole to generate hot gases and then removed whereby hydrocarbons or other materials may be recovered from the borehole.

SUMMARY OF THE INVENTION

It is an object of the invention to provide a system comprising gas generator which may be located in a borehole to produce hot gases and which allows fluids to be removed from the borehole without withdrawing the gas generator.

The system comprises a tubular member having an upper end and a lower end portion with a port. A housing surrounds a portion of the tubular member such that a chamber is formed between the wall of the housing and the tubular member. The housing has an upper end and a lower end with a port for the passage of hot gases. The system is operated to produce hot gases in the borehole by injecting a fuel, a coolant or cooling fluid, and an oxidizing fluid into the chamber to form a combustible mixture which is ignited and burned to form combustion gases for flow through the port of the housing into the borehole. After the combustion gases are produced for a sufficient period of time, the injection of the fuel, the coolant or cooling fluid, and the oxidizing fluid is terminated and a pump is lowered into the tubular member for pumping fluid from the borehole upward through the tubular member to the surface.

In the embodiment disclosed, the ports of the tubular member and of the housing are all located close to each other.

In one embodiment, the tubular member has only one port which is located at its lower end.

In another embodiment, the tubular member has an upper port which comprises at least one aperture formed through its wall. The tubular member extends through the port of the housing and has a lower port at its lower end located below its upper port and below the port of the housing. In this embodiment, during the hot gas producing process, the lower port is closed either by the pump itself or by a separate closure means. During pumping operations, the upper port of the tubular member may be closed with a closure means or by pressurized gas injected into the borehole.

DESCRIPTION OF THE PREFERRED EMBODIMENTS

Figures 1, 2:
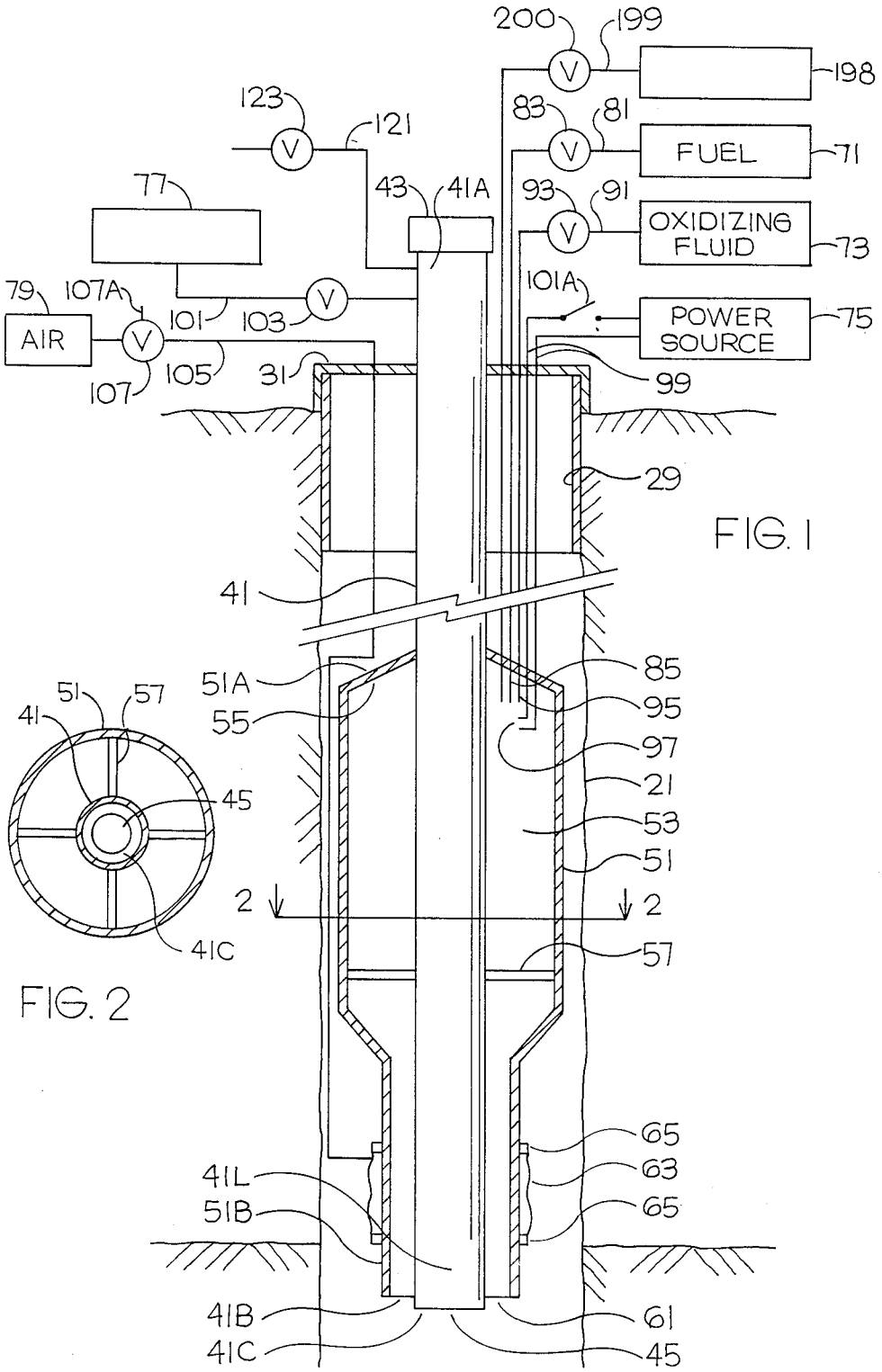
FIG. 1 illustrates one embodiment of the invention wherein a gas generator is located in a borehole and hot gases are produced in the borehole.
FIG. 2 is a cross-section of FIG. 1 taken along the lines 2—2 thereof.

Referring to FIG. 1 of the drawings, there is illustrated a well or borehole 21 drilled into the earth and penetrating a subsurface petroleum bearing formation or reservoir 27. The bottom of the borehole may be located below and near the formation 27. The borehole is partially lined with steel casing 29 from the surface and has an upper well head 31. The casing may extend further down to about the upper level of the formation 27 or below the formation 27, in which case the casing will be perforated to provide fluid communication between the inside of the borehole and the formation 27. Of interest is to inject hot gases into the formation 27 by way of the borehole 21 and subsequently to recover petroleum products from the same borehole as disclosed for example in U.S. Pat. No. 4,597,441.

Extending into the borehole 21 from the surface is a hollow tubular member 41. The upper end portion of the tubular member 41 is secured to the well head 31 and a removable cap 43 is secured to its upper end 41A. A production line 121 with a valve 123 is connected to the upper portion of the tubular member 41. The tubular member 41 may be formed by a plurality of tubular sections coupled together. The lower end 41B of the tubular member 41 is located at or near the level of the formation 27. The lower end 41B of the tubular member 41 has an opening 45 with an inward extending shoulder 41C surrounding the opening 45. In the embodiment of FIGS. 1 and 2, the opening 45 forms a port for the flow of fluids out of and into the tubular member.

Located around the lower end portion of the tubular member 41 is a housing 51 such that a chamber 53 is formed between the wall of the housing and the tubular member 41. The tubular member 41 extends through a central opening 55 formed through the upper end 51A of the housing and the upper end 51A of the housing is secured to the tubular member 41 by welding or by bolts. Spaced apart rods 57 also extend between the tubular member 41 and the lower portion of the wall of the housing 51 for supporting the housing 51 by attaching it to the tubular member 41. The lower end 51B of the housing has an annular opening or port 61 for the passage of heated gases out of the chamber 53. The ports 45 and 61 of the tubular member and of the housing are located close to each other at about the same level. The lower portion 41L of the tubular member 41 and the lower portion 51B of the housing 51 will have lengths sufficient to allow combustion gases to cool to a satisfactory temperature.

Located around the lower portion of the housing 51 above its lower end, if desired, is an inflatable packer 63 which is supported by two rims 65 secured around the housing 51.

Located at the surface are a source 71 of fuel under pressure, a source 73 of oxidizing fluid under pressure, an ignition power source 75, a source 77 of cooling fluid under pressure, and a source 79 of air under pressure for inflating the packer 63. The source 71 of fuel is coupled by line 81 and valve 83, to at least one fuel injector 85 located in the chamber 53 for injecting fuel into the chamber 53. The source 73 of oxidizing fluid is coupled by line 91 and valve 95 to at least one fuel injector 93 located in the chamber 53 for injecting an oxidizing fluid in the chamber 53 for mixing with the fuel to form a combustible mixture. The power source 75 is coupled, by way of electrical leads 99, to a spark plug or ignition device 97 located in the chamber 53 for igniting the combustible mixture to form hot gases for flow through the port 61 of the housing 51 into the borehole 21 and then into the formation 27. If desired, a different type of ignition source may be employed. The source 77 of cooling fluid is coupled to the inside of the tubular member 41 by way of line 101 and valve 103. The cooling fluid is injected down the tubular member and out of the port 45 for cooling the combustion gases in the chamber 53 from a combustion temperature down to a desired injection temperature. The cooling fluid also cools the housing 51 indirectly by cooling the combustion gases and the tubular member 41 inside of the housing 51. The contact between the coolant and the combustion gases in the chamber 53 is essentially a double pipe heat exchanger at the exit of the combustion chamber. During the production of the hot gases, the combustion gases flow down the annulus of the chamber 53 around the integral tubular member 41 and exit through port 45 at almost the same point as the gases exit from port 61 in the borehole 21 near its bottom.

The source 79 of air is coupled to the packer 63 by way of line 105 and valve 107.

In the operation of the system for the production of the hot gases, valve 123 is closed and valve 107 is actuated to supply air under pressure to the packer 63 by way of line 105 to inflate the packer 63 to form a seal between the lower outer wall of the housing 51 and the wall of the borehole 21 as shown in FIG. 2. Valves 83 and 93 are opened, switch 101A is closed and then valve 103 is opened. Once ingnition occurs, combustion will be sustained by the continued injection of oxygen, cooling fluid, and hydrogen into the chamber 53 whereby switch 101A may be opened.

In the preferred embodiment, the fuel used is hydrogen, the cooling fluid is steam, and the oxidizing fluid used is oxygen whereby the hot gases produced in the chamber 53 upon ignition of the combustible mixture in the chamber 53 is steam. Preferably a stoichiometric mixture of hydrogen and oxygen will be used. This mixture has an adiabatic flame temperature of about 5700° F. and must be cooled by the steam mixed with the fuel in order to protect the materials of construction and also preferably to produce super-heated steam for injection into the formations. Because hydrogen and oxygen are expensive, it is undesirable to use cold water or even warm water for cooling purposes since this will require more of the heat to be supplied by the hydrogen and oxygen which are expensive. In order to minimize costs, steam will be generated at the surface for cooling purposes in order to cut down the hydrogen-oxygen requirement to produce a given amount of heat in the form of super-heated steam. A further part of our invention is to use saturated steam, that is steam containing no water. Wet steam contains some water, typically 20–30% water when used to stimulate oil production. In our operations we will use dry steam for cooling purposes, particularly because of its economy, and also because its heat content is uniform. Wet steam, being a mixture of water and dry steam, has a tendency to separate especially in passing through nozzles and producing nonuniform mixtures. The ratio of the mass flow of the steam passing down the tubular member 41 and the gases leaving the combustion chamber 53 will determine the temperature at which the super-heated steam will be injected into the formation.

Instead of using the steam from the source 77 for cooling purposes, a coolant, which is an excess of hydrogen, may be injected into the chamber 51 from a source 198 of hydrogen and by way of line 199 and valve 200. In this mode, the source 77 may also be hydrogen.

Figure 3:
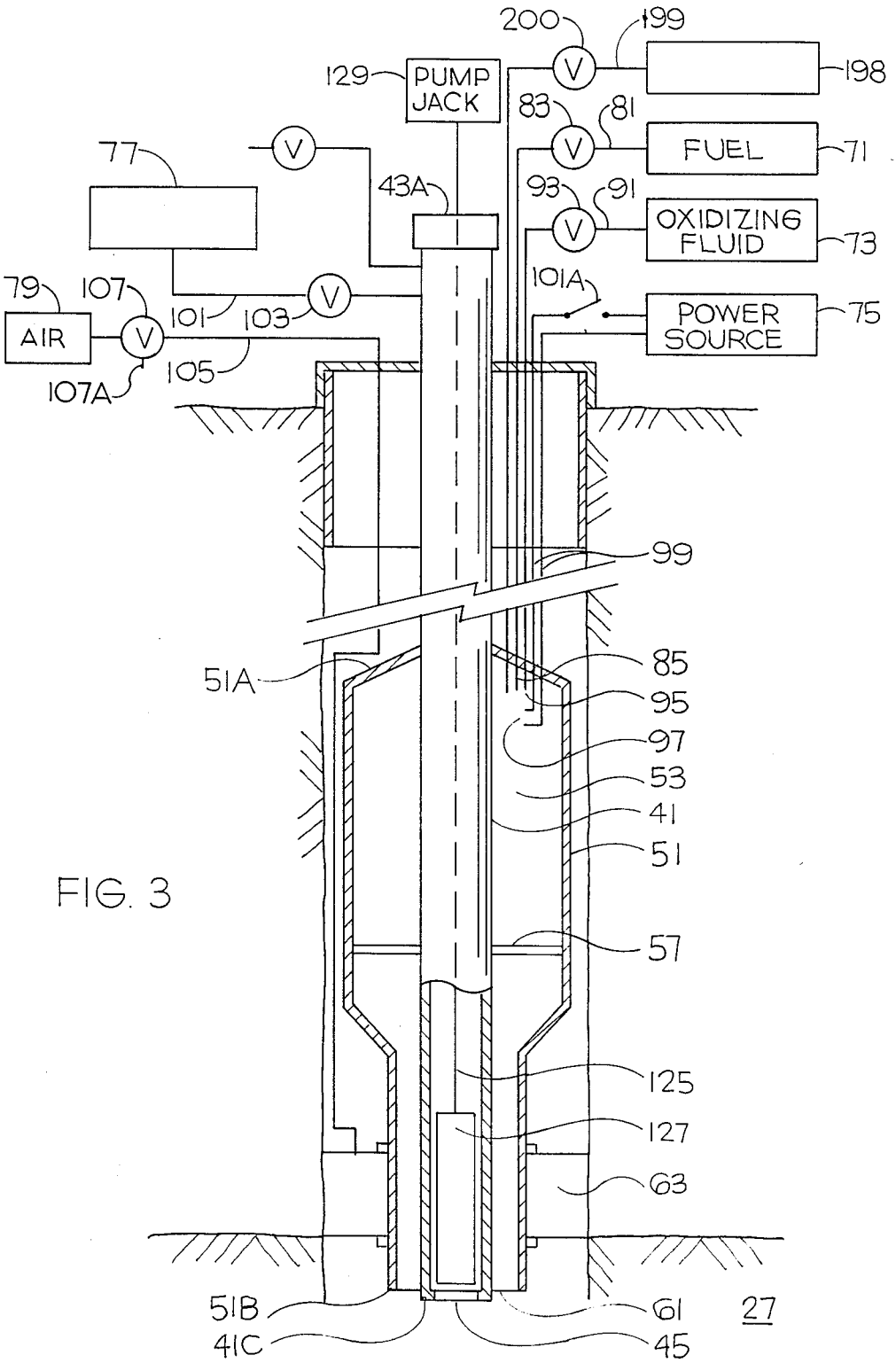
FIG. 3 illustrates the embodiment of FIG. 1 wherein fluid in the borehole is pumped to the surface by way of a tubular member extending through the gas generator.

During the steaming operation, the combustion gases produced in the chamber 53 flow down the annulus around the integral tubular member 41 and exit from the port 61 near the bottom of the well as indicated above. During the production period, the oil that is being produced from the reservoir enters the bottom of the well and forms a pool in the bottom. Prior to production, the formation of the hot gases in the chamber is terminated as well as the flow of the cooling gases through the tubular member 41. This is carried out by closing valves 83, 93, and 103. The packer 63, if used, is left inflated. After the steaming and/or hydrogen injection operation, production may be delayed for a suitable period of time for example as disclosed in the various embodiments in U.S. Pat. No. 4,597,441. For production operations, valve 123 will be opened, cap 43 will be removed and a sucker rod 125 with a suitable pump 127 coupled to its lower end will be lowered down the inside of the tubular member 41 as to a position as shown in FIG. 3. A modified cap 43A having a suitable opening for the sucker rod 125 will be connected to the upper end 41A of the tubular member and the upper portion of the sucker rod 125 connected to a suitable pump jack 129. The pump jack 129 will be operated in a conventional manner to cause the pump 127 to pump liquids in the bottom of the borehole 21 upward through the port 45 and upward through the tubular member 41 for flow through the production line 121 to a suitable storage facility. With this arrangement, the gas generator does not have to be removed from the borehole for production purposes thereby facilitating production at a more economic cost than if the gas generator had to be removed and a production tube then inserted into the borehole for production purposes following steaming operations.

In order to deflate the packer 63, the valve 107 will be operated to vent the packer to the atmosphere through line 103, valve 107, and vent line 107A.

Instead of using the packer 63, the borehole may be pressurized by injecting air or inert nitrogen or helium into the borehole to prevent the fluids from flowing up the borehole around the tool during the heating and pumping operations, if desired. In this alternative, a source 151 of air or inert gas and line 153 and valve 155, as shown in FIG. 4, may be employed.

Figures 4, 5:
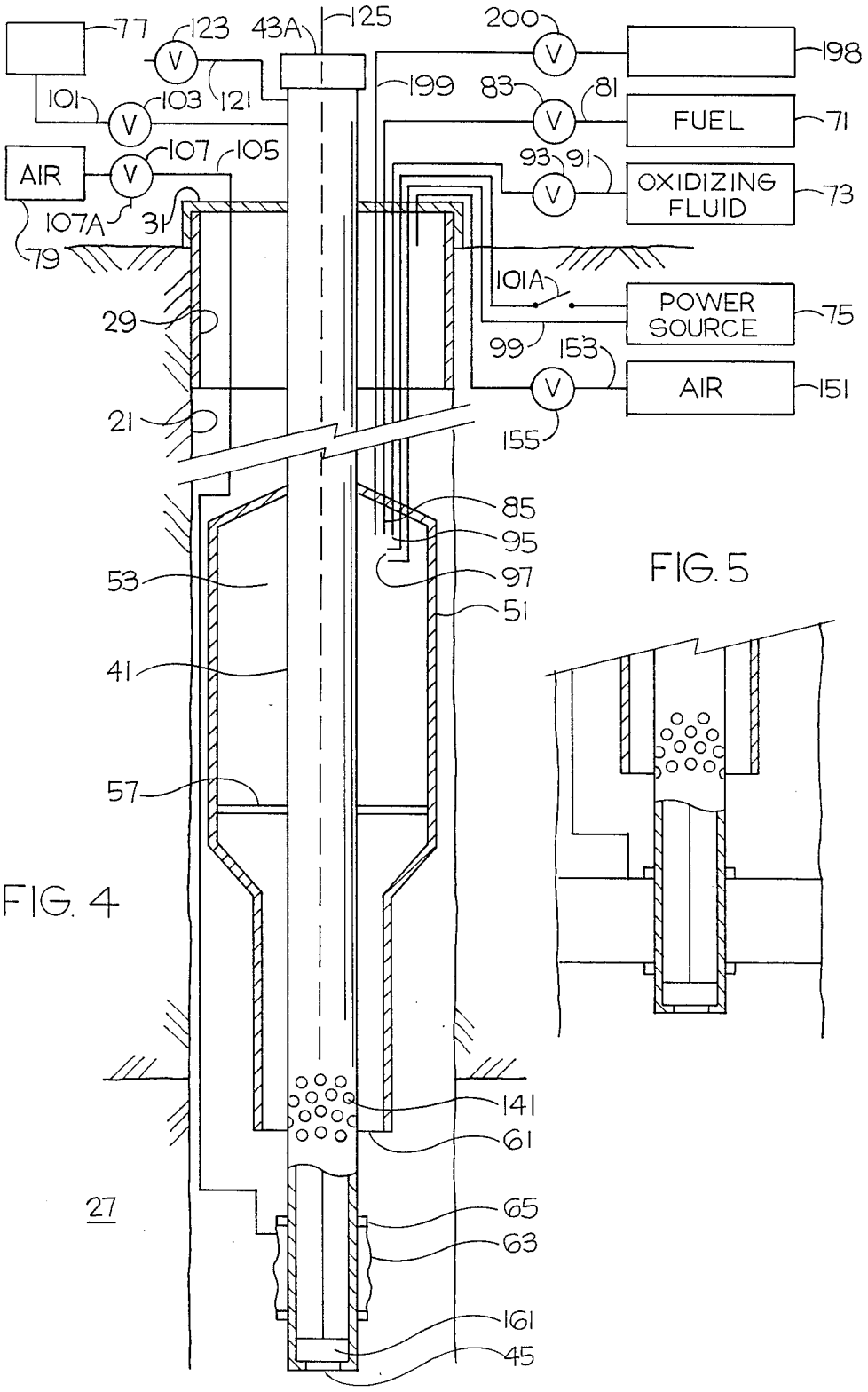
FIG. 4 is a modification of the invention wherein the tubular has an upper port and a lower port and a packer is located around the tubular member between its two ports.
FIG. 5 is a partial view of FIG. 4, with the packer expanded.

Referring now to FIGS. 4 and 5, the system disclosed therein is similar to that of FIG. 1–3 except that the tubular member 41 has been extended down below the port 61 of the housing 51 and it has apertures formed through the wall thereof for the discharge of the cooling fluid which directly contacts the hot gases exiting from port 61. In addition, a source 151 of air or inert nitrogen or helium under pressure is employed to pressurize the borehole during production. In the embodiments of FIGS. 1–3 and FIGS. 4, and 5, like reference numerals identify like components. As shown in FIGS. 4 and 5, apertures 141 are formed through the wall of the tubular member 41 near the level of the port 61 of the housing. The apertures 141 define an upper port and the lower opening 45 defines a lower port of the tubular member 41. The packer 63, if desired, is located around the lower portion of the tubular member 41 below the housing port 61 and the apertures 141 formed through the wall of the tubular member 41. A source 151 of pressurized gas is coupled to the interior of the borehole 21 by way of line 153 and valve 155. Also provided is a removable plug 161 which may be located at the bottom of the tubular member by way of the sucker rod 125 to plug the opening 45 during steaming operations. During steaming operations, the packer 63 is deflated by operating valve 107 to vent the packer 63 to the atmosphere. Valves 83 and 93 are opened to provide oxygen and hydrogen in the chamber 53 to form a combustible mixture which is ignited by the spark plug 97 by closing the switch 101A. Valve 123 is closed as well as valve 155. The cooling steam is injected into the tubular member 41 by opening the valve 103. Since the opening 45 is closed by the plug 161, the cooling steam flows out of the apertures 141 and mixes directly with the combustion gases flowing in the chamber 53 and out of the port 61. If hydrogen is used for cooling purposes, an excess of hydrogen is injected into the chamber 51, by opening valve 200 instead of valve 103. After the steaming and/or hydrogen injection operations are completed, valve 83, 93, and 103/200 are closed and when it is desired to produce the liquids in the borehole, the plug 161 and the sucker rod 125 are removed from the tubular member 41 and the sucker rod 125 with the pump 127 is inserted into the tubular member 41 and the upper end of the sucker rod 125 is connected to the pump jack 129. The valve 107 is actuated to apply air under pressure to the line 105 to inflate the packer 63, if it is employed; the valve 123 is opened and in addition; the valve 155 is opened to apply gas under pressure into the borehole 21. Upon operation of the pump jack, the liquid in the borehole is pumped through the opening 45 upward into the tubular member 41 and out of the production line 121. The gas pressure in the borehole above the packer 63 prevents the oil from escaping through the apertures 141 into the annulus of the housing 51 when the pump jack 129 is in operation pumping the oil up the tubular member 41. The gas pressure in the borehole is sufficient to block the flow of oil from the tubular member 41 outward through the apertures 141 and provides a slight gas flow from the space surrounding the tubular member 41 through the apertures 141 into the tubular member 41 where the gas will pass upward with the other fluids and out of the production line 121. The gas under pressure in the borehole thus will provide a gas lift.

In the embodiment of FIGS. 4 and 5, a pump, similar to pump 127 of FIG. 3, may be located at the bottom of the tubular member 41 to serve as a plug during the steaming operation while the pump is maintained inoperative.

Figure 6:
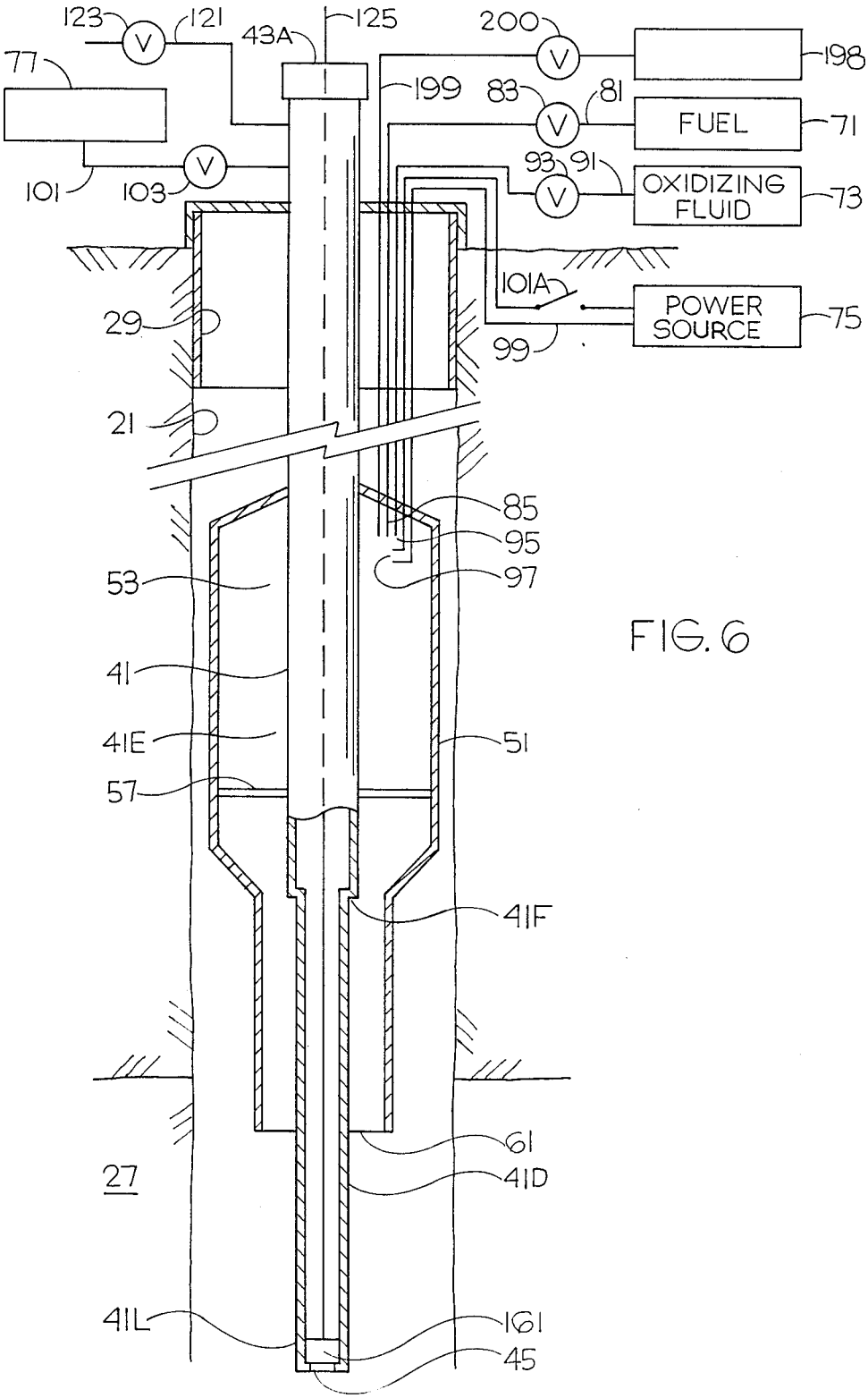
FIG. 6 is another modification of the invention wherein the upper port of tubular member is formed by apertures formed through a shoulder of the tubular member.
Figure 7:
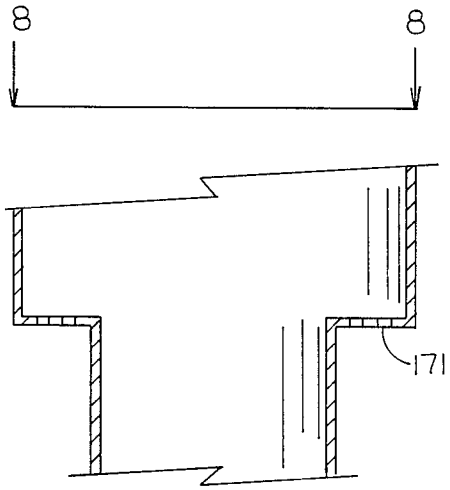
FIG. 7 is a partial enlargement of the shoulder of the tubular member of FIG. 6 illustrating the apertures formed through the shoulder.
Figure 9:
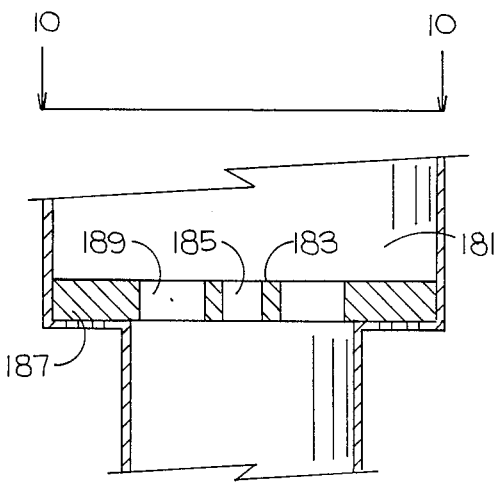
FIG. 9 is a view similar to that of FIG. 7 but with a closure member located on the shoulder closing the apertures.
Figure 8:
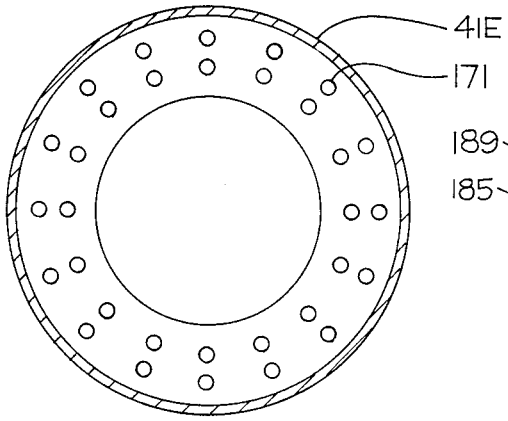
FIG. 8 is a view of FIG. 7 taken along lines 8—8 thereof.
Figure 10:
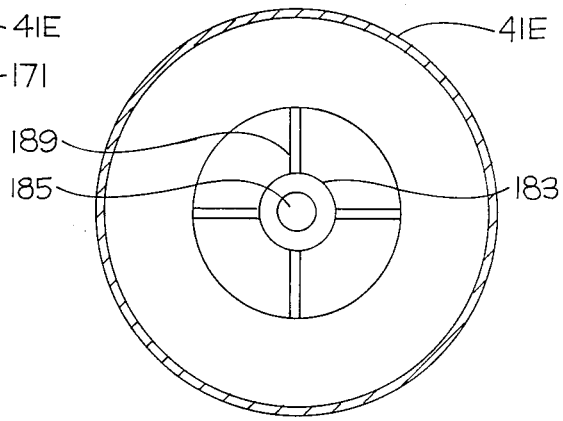
FIG. 10 is a view of FIG. 9 taken along the lines 10—10 thereof.

Referring to FIGS. 6–10, the system disclosed therein is similar to that of FIGS. 1–3 except the port of the tubular member 41 through which the cooling steam is injected is formed through a shoulder of the tubular member located within the lower end of the chamber 53 of the housing 51. In addition, a removable closure member is provided for the port formed through the shoulder and the lower end of the tubular member 41 extends below the port of a housing member. In addition, the packer 63 is eliminated. In the embodiments of FIGS. 6–10 and 1–3, like components are identified by like reference numerals. As shown in FIG. 6, the lower portion 41D of the tubular member 41 has a smaller diameter than the upper portion 41E with a shoulder 41F extending between the two portions within the chamber 53 at the lower end of the housing 51. As shown in FIG. 7 and 8, apertures 171 are formed through the shoulder 41F. In addition, the lower end 41L of the lower portion 41D of the tubular member 41 extends to a position further below the housing port 61 than in the embodiment of FIGS. 1–3 although is not necessary that it extend this low. Aperture 171 define an upper port and the lower opening 45 defines a lower port of the tubular member 41. For steaming operations, the sucker rod 125 with the closure plug 161 is lowered into the tubular member 41 to close the opening 45 as shown in FIG. 6. For steaming purposes, the valves 83 and 93 are opened to form a combustible mixture of hydrogen and oxygen in the chamber 53 which is ignited by the spark plug 97 upon closure of the switch 101A. The valve 103 is opened to allow cooling steam to flow into the tubular member 41 and downward where it passes through the apertures 171 formed through the shoulder 41F and directly mixes with the combustion gases flowing downward through the chamber 53 and out of the housing port 61. During this process, the plug 161 prevents the flow of the cooling steam through the opening 45. If hydrogen is used for cooling purposes, an excess of hydrogen is injected into the chamber 51 by opening valve 200 instead of valve 103. After the steaming and/or hydrogen injection operations are carried out for the desired period of time, the valves 83, 93, and 103/200 are closed. After waiting the desired period, the sucker rod 125 and the plug 161 are removed and the sucker rod 125 with the pump 127 connected thereto are lowered into the tubular member 41 to locate the pump 127 at a position next to the opening 45. A closure member 181 as illustrated in FIGS. 9 and 10 is employed to close the apertures 171. The closure member 181 comprises a central hub 183 having a central aperture 185 formed therethrough and an outer rim 187 connected to the hub 183 by spaced apart arms 189. As the sucker rod 125 with the pump 127 are inserted into the tubular member 45, the sucker rod may be extended through the central opening 185 of the closure member 181 whereby the closure member 181 may be lowered down into the tubular member 41 until it rests on the upper surface of the shoulder 41F closing the apertures 171. The opening 185 is sufficient to allow the sucker rod to move freely through the opening 185. The closure member 181 may be located upon the shoulder 41F as the sucker rod 125 is lowered or after the sucker rod 125 is lowered to its desired position, the hub 183 may be located around the sucker rod and the closure member 181 then allowed to slide down the sucker rod to the upper surface of the shoulder 41F for closing the apertures 171. The pump jack 129 then is connected to the upper end of the sucker rod 125 and the valve 123 opened. During operation of the pump jack, the pump 127 pumps liquid in the borehole through the opening 45 and upward through the tubular conductor 41 for flow through the production pipe 121. The closure member 181 prevents the liquid pumped upward through the tubular member 41 from flowing through the apertures 171 back into the annulus of the housing 51 and out the port 61 as the pump is operating. After pumping operations are completed, the closure member 181 may be removed by removing the sucker rod 125 and pump 127. As the sucker rod 125 rises through the central opening 185 of the closure member 181 the pump 127 will engage the underside of the annular closure member 181 and lift it up and carry it to the surface. If the pump 127 in an inoperative condition is used as the plug at the bottom of the tubular member 41 during steaming, the annular plug 181 can be located on the shoulder 41F by allowing it to slide down the sucker rod 125 to the shoulder 41F to close the apertures 171 during production operations. If the steaming and/or hydrogen injection cycle is to be repeated, the annular plug 181 can be removed by attaching a wire to it and lifting it to the surface.

In the embodiment of page 1-3, the integral tubular member 41 may be a standard sucker rod pipe string with a sucker rod therein. The sucker rod string has the housing 51 attached thereto forming the combustion chamber 53. The integral tubular member/sucker rod string in this embodiment will be constructed to withstand temperatures used for steam or hydrogen injection (500°-700° F.).

We claim:

1. A system for use for recovering hydrocarbons or other materials from underground formations penetrated by a borehole, comprising:

a tubular member extending from the surface into said borehole, said tubular member having a lower end portion with a port means, a housing located in said borehole and surrounding a portion of said tubular member such that a chamber is formed between the wall of said housing and said tubular member, said housing having a closed upper end located below the surface and a lower end with a port means for the passage of heated gases, said housing being separated and apart from the inside wall of said borehole, means for injecting a fuel and an oxidizing fluid into said chamber to form a combustible mixture therein, means for igniting the combustible mixture in said chamber for combustion for forming hot combustion gases for flow through said port means of said housing, and a pump adapted to be located in said tubular member at a level sufficient to pump fluid from said borehole upward through said tubular member to the surface when hot combustion gases are not being formed.

2. The system of claim 1, wherein:

said tubular member has a lower open end defining said port means of said tubular member.

3. The system of claim 1, wherein:

said port means of said tubular member is located at a level near said port means of said housing.

4. The system of claim 1, wherein:

said port means of said tubular member is defined as a first port means of said tubular member, said tubular member extends through said port means of said housing, said first port means of said tubular member comprises at least one aperture formed through the wall of said tubular member, said lower end portion of said tubular member comprises a lower opening defining a second port means of said tubular member located below said first port means of said tubular member and below said port means of said housing, means for injecting a cooling fluid into said tubular member, said second port means of said tubular member being adapted to be closed and opened whereby said second port means of said tubular member may be closed during the injection of cooling fluid into said tubular member and opened when said pump is located in said tubular member.

5. The system of claim 4, comprising:

means for closing and opening said second port means of said tubular member.

6. The system of claim 4, wherein:

said lower end portion of said tubular member is constructed to allow said pump to be lowered into said tubular member below said first port means of said tubular member for closing said second port means when said pump is not operating.

7. The apparatus of claim 4, comprising:

means separate from said pump means for opening and closing said second port means of said tubular member.

8. The system of claim 4, comprising:

an expandable packer located around said lower end portion of said tubular member below said port means of said housing, below said first port means of said tubular member, and above said second port means of said tubular member.

9. The system of claim 4, wherein:

said tubular member comprises an upper portion of a first diameter and said lower end portion of a diameter less than that of said first diameter with a shoulder extending between said upper portion and said lower end portion of said tubular member, said first port means of aid tubular member comprises at least one aperture formed through said shoulder, and means adapted to be located on said shoulder within said tubular member and removed therefrom for closing and opening said first port means of said tubular member.

10. A system for use for recovering hydrocarbons or other materials from underground formations penetrated by a borehole, comprising:

a tubular member having an upper end and a lower end portion with a port means, a housing surrounding a portion of said tubular member such that a chamber is formed between the wall of said housing and said tubular member, said housing having a closed upper end and a lower end with a port means for the passage of heated gases, means for injecting a fuel and an oxidizing fluid into said chamber to form a combustible mixture therein, means for igniting the combustible mixture in said chamber for forming hot combustion gases for flow through said port means of said housing, said tubular member and said housing being adapted to be located in a borehole penetrating underground formations with said lower end portion of said tubular member and said lower end of said housing being located below their upper ends respectively and with said upper end of said housing being located below the surface and said housing being separate and apart from the inside wall of said borehole whereby when a combustible mixture is formed in said chamber and ignited, hot combustion gases will flow through said port means of said housing and into said borehole, said tubular member being capable of receiving a pump through its upper end to a level sufficient to pump fluid from the borehole upward through said tubular member when combustion gases are not being formed.

11. The system of claim 10, wherein:

said tubular member has a lower open end defining said port means of said tubular member.

12. The system of claim 10, wherein:

said port means of said tubular member is located at a level near said port means of said housing.

13. The system of claim 10, wherein:

said port means of said tubular member is defined as a first port means of said tubular member, said tubular member extends through said port means of said housing such that said lower end portion of said tubular member is located below said port means of said housing and below said first port means of said tubular member, said first port means of said tubular member comprises at least one aperture formed through the wall of said tubular member, said lower end portion of said tubular member comprises a lower opening defining a second port means of said tubular member located below said first port means of said tubular member and below said port means of said housing, said tubular member being adapted to have a cooling fluid injected therein, said second port means of said tubular member being adapted to be closed and opened whereby said second port means of said tubular member may be closed during the injection of cooling fluid into said tubular member and opened when said pump is located in said tubular member.

14. The system of claim 13, comprising:

means for closing and opening said second port means of said tubular member.

15. The system of claim 13, wherein:

said lower end portion of said tubular member is constructed to allow said pump to be lowered into said tubular member below said first port means of said tubular member for closing said second port means when said pump is not operating.

16. The system of claim 13, comprising:

means separate from said pump means for opening and closing said second port means of said tubular member.

17. The system of claim 13, comprising:

an expandable packer located around said lower end portion of said tubular member below said port means of said housing, below said first port means of said tubular member, and above said second port means of said tubular member.

18. The system of claim 13, wherein:

said tubular member comprises an upper portion of a first diameter and said lower end portion of a diameter less than that of said first diameter with a shoulder extending between said upper portion and said lower end portion of said tubular member, said first port means of said tubular member comprises at least one aperture formed through said shoulder, and means adapted to be located on said shoulder within said tubular member and removed therefrom for closing and opening said first port means of said tubular member.

19. A method of recovering hydrocarbons or other materials from underground formations penetrated by a borehole employing a system comprising a tubular member extending from the surface into said borehole and which has a lower end portion with a port means, a housing located in said borehole and surrounding a portion of said tubular member such that a chamber is formed between the wall of said housing and said tubular member, said housing having a lower end with a port means for the passage of heated gases, said method comprising the steps of:

injecting a fuel and an oxidizing fluid from the surface into said chamber to form a combustible mixture therein, igniting the combustible mixture in said chamber for combustion for forming hot combustion gases for flow through said port means of said housing, terminating the injection of said fuel and oxidizing fluid into said chamber, locating a pump in said tubular member at a level sufficient to pump fluid from the borehole upward through said tubular member to the surface and, operating said pump to pump fluid from said borehole upward through said tubular member to the surface.

20. The method of claim 19, wherein said tubular member has a lower open end defining said port means of said tubular member, said method comprising the step of:

injecting a cooling fluid into said tubular member, said cooling fluid when injected into said tubular member flows out of said lower open end and said fluid pumped from said borehole passes through said lower open end into said tubular member and upward to the surface.

21. The method of claim 20 wherein said port means of said tubular member is defined as a first port means of said tubular member, said tubular member extends through said port means of said housing such that said lower end portion of said tubular member is located below said port means of said housing, said first port means of said tubular member comprises at least one aperture formed through the wall thereof, said lower end portion of said tubular member comprises a lower opening defining a second port means of said tubular member located below said first port means of said tubular member, said method comprises the steps of:

allowing the flow of fluid through said second port means of said tubular member when said pump is located in said tubular member and operated to pump fluid from said borehole through said second port means upward through said tubular member to the surface.

22. The method of claim 21, comprising the steps of during the operation said pump:

locating a packer around said lower end portion of said tubular member below said port means of said housing below said first port means of said tubular member and above said second port means of said tubular member and forming a seal with said packer between said lower end portion of said tubular member and the wall of said borehole, and injecting a gas under pressure in said borehole above said packer to prevent fluid from flowing from said tubular member back into said borehole by way of said first port means of said tubular member.

23. The method of claim 21, comprising the step of during the operation of said pump, blocking the flow of fluid through said first port means of said tubular member to prevent fluid from flowing from said tubular member back into said borehole by way of said first port means of said tubular member.

24. A system for use for recovering hydrocarbons or other materials from underground formations penetrated by a borehole, comprising:

a tubular means extending from the surface into said borehole, said tubular means having a lower end portion with a port means, a housing located in said borehole and surrounding a portion of said tubular means such that a chamber is formed between the wall of said housing and said tubular means, said housing having a closed upper end located below the surface and a lower end with a port means for the passage of heated gases, said housing being separate and apart from the inside wall of said borehole, means for injecting a fuel and an oxidizing fluid into said chamber to form a combustible mixture therein, and means for igniting the combustible mixture in said chamber for combustion for forming hot combustion gases for flow through said port means of said housing, said tubular means allowing fluid from said borehole to be recoverable by passage upward through said tubular member to the surface when hot combustion gases are not being formed.

25. A system for use for recovering hydrocarbons or other materials from underground formations penetrated by a borehole comprising:

a tubular means having an upper end and a lower end portion with a port means, a housing surrounding a portion of said tubular means such that a chamber is formed between the wall of said housing and said tubular means, said housing having a closed upper end and a lower end with a port means for the passage of heated gases, means for injecting a fuel and an oxidizing fluid into said chamber to form a combustible mixture therein, means for igniting the combustible mixture in said chamber for forming combustion gases for flow through said port means of said housing, said tubular means and said housing being adapted to be located in a borehole penetrating underground formations with said lower end portion of said tubular member and said lower end of said housing being located below their upper ends respectively and with said upper end of said housing being located below the surface and said housing being separate and apart from the inside wall of said borehole whereby when a combustible mixture is formed in said chamber and ignited, hot combustion gases will flow through said port means of said housing and into said borehole, said tubular means allowing fluid from the borehole to be recoverable by passage upward through said tubular means when combustion gases are not being formed.

26. A method of recovering hydrocarbons or other materials from underground formations penetrated by a borehole employing a system comprising a tubular means extending from the surface into said borehole and which has a lower end portion with a port means, a housing located in said borehole and surrounding a portion of said tubular means such that a chamber is formed between the wall of said housing and said tubular means, said housing being separate and apart from the inside wall of said borehole and having a closed upper end located below the surface and a lower end with a port means for the passage of heated gases, said method comprising the steps of:

injecting a fuel and an oxidizing fluid from the surface into said chamber to form a combustible mixture therein, igniting the combustible mixture in said chamber for combustion for forming hot combustible gases for flow through said port means of said housing, terminating the injection of said fuel and oxidizing fluid into said chamber, and flowing fluid from the borehole upward through said tubular means to the surface.

* * * * *